United States Patent [19]

Endo et al.

[11] Patent Number: 5,039,563

[45] Date of Patent: Aug. 13, 1991

[54] SURFACE TREATING AGENT BEFORE COATING

[75] Inventors: Koetsu Endo, Yawata; Akio Tokuyama, Hirakata, both of Japan

[73] Assignee: Nippon Paint Co., Ltd., Osaka, Japan

[21] Appl. No.: 425,834

[22] Filed: Oct. 20, 1989

[30] Foreign Application Priority Data

Oct. 20, 1988 [JP] Japan ..... 63-266580

[51] Int. Cl.[5] ..... B05D 3/00; C04B 9/02

[52] U.S. Cl. ..... 427/327; 106/14.12; 148/255; 148/262; 204/181.3

[58] Field of Search ..... 427/327; 106/14.12; 204/181.3; 148/255, 259, 262, 263

[56] References Cited

U.S. PATENT DOCUMENTS

| | | | |
|---|---|---|---|
| 2,257,133 | 9/1941 | Shoemaker | 427/327 |
| 2,337,856 | 12/1943 | Rice et al. | 148/263 |
| 2,930,723 | 3/1960 | Drysdale et al. | 148/6.15 |
| 4,131,517 | 12/1978 | Mitsuo et al. | 204/27 |
| 4,168,983 | 9/1979 | Vittands et al. | 106/14.12 |
| 4,292,096 | 9/1981 | Murakami et al. | 204/181.3 |
| 4,311,535 | 1/1982 | Yasuhara et al. | 204/181.3 |
| 4,324,684 | 4/1982 | Geiger et al. | 106/14.12 |
| 4,474,626 | 10/1984 | Lumaret et al. | 148/259 |
| 4,637,838 | 1/1987 | Rausch et al. | 148/6.15 Z |

FOREIGN PATENT DOCUMENTS

| | | |
|---|---|---|
| 0154367 | 9/1985 | European Pat. Off. . |
| 1062082 | 7/1959 | Fed. Rep. of Germany . |
| 2018834A | 10/1979 | United Kingdom . |

*Primary Examiner*—Michael Lusignan
*Assistant Examiner*—Diana L. Dudash
*Attorney, Agent, or Firm*—Wenderoth, Lind & Ponack

[57] ABSTRACT

Disclosed is a surface treating agent which improves the adhesive properties between a metal surface and a paint layer thereon. The surface treating agent is an acidic aqueous solution comprising zinc ions, nickel ions and phosphate ions, characterized by adding a cyclic metaphosphate thereto in the form of $(MPO_3)_n$ wherein M represents a metal atom and n is an integer of at least 4 in a concentration of 20 to 600 mg/l.

5 Claims, No Drawings

SURFACE TREATING AGENT BEFORE COATING

FIELD OF THE INVENTION

The present invention relates to a surface treating agent before coating metal, such as steel or zinc.

BACKGROUND OF THE INVENTION

Before coating a metal surface with a paint, the surface is generally treated with a zinc phosphate solution in order to enhance corrosion resistance and the adhesive properties between the metal surface and a paint layer thereon. However, corrosive environments are getting worse in automobiles, because a large amount of salt is spread over roads in winter. A primer coating is accordingly changed from anionic electrocoating to cationic electrocoating, and the surface treatment of the zinc phosphate solution is improved to suit to the cationic electrocoating method.

In the cationic electrocoating method, however, residual stress remains in a cured film so as to deteriorate adhesive properties, thus deteriorating corrosion resistance. In other words, the volume contraction at baking a coating forms internal stress in coating and deteriorates the adhesive properties between the metal surface and the cured film. The deterioration of the adhesive properties does not appear under conventional salt spray test conditions. But, if a salt spray test is conducted at more severe conditions, corrosion resistance significantly declines.

SUMMARY OF THE INVENTION

The present invention provides a surface treating agent which improves the adhesive properties between a metal surface and a paint layer thereon. The surface treating agent is an acidic aqueous solution comprising zinc ions, nickel ions and phosphate ions, characterized by adding a cyclic metaphosphate thereto in the form of $(MPO_3)_n$ wherein M represents a metal atom and n is an integer of at least 4 in a concentration of 20 to 600 mg/l.

The present invention also provides a surface treating method before coating a metal surface comprising contacting the metal surface with the surface treating agent, followed by coating with a paint.

DETAILED DESCRIPTION OF THE INVENTION

The cyclic metaphosphate employed in the present invention includes an alkali metal salt, such as a sodium salt and a potassium salt, an ammonium salt and an alkali earth metal salt. It is generally represented by $(MPO_3)_n$, but in the present invention n should be an integer of at least 4, preferably 4 to 9, thus excluding $n=3$ or cyclic trimetaphosphate which does not provide good effects in enhancing adhesive properties. Concrete examples of the cyclic metaphosphate are sodium metaphosphate $[(NaPO_3)_n;n>3]$ according to JIS-K-8892, sodium tetrametaphosphate and sodium hexametaphosphate. The amount of the cyclic metaphosphate is within the range of 20 to 600 mg/l preferably 50 to 400 mg/l in the form of $(MPO_3)_n;n>3$. Amounts of less than 20 mg/l reduce scab resistance. Amounts of more than 600 mg/l lower coating weight, thus causing a rough surface.

The zinc ion in the surface treating agent can be provided from zinc phosphate, zinc nitrate, zinc carbonate, zinc hydroxide, zinc oxide, zinc metal and the like. The zinc ion may be present in the surface treating agent in an amount of 600 to 2,000 mg/l, preferably 600 to 1500 mg/l. Amounts of less than 600 mg/l provide a rough surface and deteriorate corrosion resistance. Amounts of more than 2,000 mg/l are too large in coating weight, thus causing poor adhesive properties and corrosion resistance.

The nickel ion of the surface treating agent of the present invention may be provided from nickel phosphate, nickel nitrate, nickel carbonate, nickel oxide and the like. The nickel ion may be present in an amount of at least 50 mg/l preferably 500 to 2,000 mg/l. If the amount of nickel ion is less than 50 mg/l the adhesion properties are poor. If it is more than 2,000 mg/l the adhesion properties are not enhanced in proportion to the increase of the amount, thus being uneconomical.

The phosphate ion may be provided from orthophosphoric acid, an alkali or ammonium salt thereof, pyrophosphoric acid, an alkali or ammonium salt thereof, tripolyphosphoric acid, an alkali or ammonium salt thereof and the like. The ion may be present in an amount of 800 to 30,000 mg/l preferably 800 to 20,000 mg/l. Amounts of less than 800 mg/l provide a rough surface and lack of hinding. Amounts of more than 30,000 mg/l do not form a zinc phosphate film and reduce corrosion resistance.

The surface treating agent of the present invention may further contain other ions, such as nitrate ion, nitrite ion, chlorate ion, nitrobenzensulfonate ion, ferric ion, manganese ion, ferrous ion, cobalt ion, aluminum ion, magnesium ion, tungsten ion, fluorine ion and the like.

The nitrate ion may be provided as sodium nitrate, ammonium nitrate, zinc nitrate, manganese nitrate and the like, and be present in an amount of 1,000 to 10,000 mg/l preferably 2,000 to 8,000 mg/l.

The nitrite ion may be introduced from $NaNO_2$, $KNO_2$ or $HNO_2$. The amount of the nitrite ion is within the range of 10 to 1,000 mg/l. Amounts of less than 10 mg/l do not act as a promoter. Amounts of more than 1,000 mg/l will change the steel surface to a passive state and insufficiently form a surface treating film.

The chlorate ion may be provided from sodium chlorate, ammonium chlorate and the like. The amount of the chlorate ion can be 50 to 2,000 mg/l, preferably 200 to 1,500 mg/l.

The manganese ion may be introduced from manganese carbonate, manganese nitrate, manganese chloride, manganese phosphate and the like. It may be present in an amount of 600 to 3,000 mg/l preferably 800 to 2,000 mg/l. Amounts of less than 600 mg/l deteriorate adhesive properties between the coating and the metal surface. Amounts of more than 3,000 mg/l do not improve in proportion to the increase of the amount.

The fluorine ion may be introduced from hydrofluoric acid, silicofluoric acid, borofluoric acid and the like. It may be present in an amount of at least 50 mg/l preferably 100 to 2,000 mg/l. Amounts of less than 50 mg/l deteriorate corrosion resistance.

The surface treating method of the present invention can be conducted on a metal surface, such as a steel surface, a zinc plated surface or a combined surface thereof. The metal surface is preliminary degreased and rinsed with water. The rinsed surface is treated with a surface conditioning agent by spraying or dipping and then treated with the surface treating agent of the present invention. The treating method of the present invention can be conducted at a temperature of 20° to 60 ° C., preferably 30° to 50 ° C. If the temperature is too high, the metaphosphate would be hydrolyzed. It the temperature is lower, the treating period of time would be prolonged. The treatment may be carried out by spraying or dipping for at least 30 seconds, preferably 1 to 3 minutes.

After treating the metal surface with the surface treating agent, it is rinsed with water and then cationically electrocoated.

The treatment of the present invention can effectively inhibit scab corrosion on the steel surface. The scab corrosion is a corrosion when iron is placed especially in conditions that a dry atmosphere and wet atmosphere are alternatively repeated. The scab corrosion generally raises the coatings thereon to form blisters. If the adhesive power is improved, the scab corrosion would be effectively prevented.

EXAMPLES

The present invention is illustrated by the following Examples which, however, are not to be construed as limiting the present invention to their details.

EXAMPLES 1 TO 10 AND COMPARATIVE EXAMPLES 1 TO 9

A steel test panel was treated as follows.

(1) Degrease

The panel was dipped in a 2 wt % alkali degreasing agent (SURFCLEANER SD 250 available from Nippon Paint Co., Ltd.) at 40 ° C. for 2 minutes.

(2) Rinse

It was then rinsed with water at room temperature for 15 seconds.

(3) Surface conditioning

The rinsed panel was dipped in a 0.05 wt % surface conditioning agent (SURFFINE 5N-5 available from Nippon Paint Co., Ltd.) at room temperature for 15 seconds.

(4) Chemical treatment

An oxidizing agent ($NO_2^-$) was added to a composition shown in Table 1 at a concentration of 60 mg/l and the test panel was then dipped therein at 40 ° C. for 2 minutes.

(5) Rinse

The panel was rinsed with water at room temperature for 15 seconds.

(6) Rinse with ion-exchanged water

It was rinsed with ion-exchanged water at room temperature for 15 seconds.

(7) Coating

The treated panel was electrocoated with a cation electrodeposition paint (POWER TOP U-50 available from Nippon Paint Co., Ltd.) at 180 volts for 3 minutes to form a film having a thickness of 20 micrometers, and then baked at 175 ° C. for 20 minutes. The electrocoated panel was coated with an intermediate paint (ORGA S-93 available from Nippon Paint Co., Ltd.) in a thickness of 40 micrometers and then coated with a finishing paint (ORGA S-63 White available from Nippon Paint Co., Ltd.) in a thickness of 40 micrometers. It was baked at 140 ° C. for 25 minutes.

The coated panel was evaluated by a scab test. In the scab test, the coated panel was cross-cut and placed in the following conditions.

| | |
|---|---|
| (a) Salt spray (JIS-Z-2371) | 24 hours |
| (b) 85% relative humidity at 40° C. | 120 hours |
| (c) Allow to stand in a room | 24 hours |

After the cycle (a) to (c) was repeated 10 times, the size of blisters was measured and the results are shown in Table 1.

TABLE 1

| | Examples | | | | | | | | | | Comparative Example | | | | | | | | |
|---|---|---|---|---|---|---|---|---|---|---|---|---|---|---|---|---|---|---|---|
| Bath Composition | 1 | 2 | 3 | 4 | 5 | 6 | 7 | 8 | 9 | 10 | 1 | 2 | 3 | 4 | 5 | 6 | 7 | 8 | 9 |
| Sodium metaphosphate* (mg/l) n > 3 | 50 | 100 | 200 | 400 | 600 | | | | | | | | | | | | 900 | | |
| Sodium tetrametaphosphate (mg/l) n = 4 | | | | | | 50 | 200 | 400 | | | | | | | | | | 900 | |
| Sodium hexametaphosphate (mg/l) n = 6 | | | | | | | | | 50 | 400 | | | | | | | | | |
| Sodium trimetaphosphate (mg/l) n = 3 | | | | | | | | | | | | 50 | 400 | 900 | | | | | |
| Sodium tripolyphosphate (mg/l) | | | | | | | | | | | | | | | 200 | 5,000 | | | |
| $PO_4$ (mg/l) | | | | | | | | | | 1,600 | | | | | | | | | |
| Zn (mg/l) | | | | | | | | | | 1,200 | | | | | | | | | |
| Ni (mg/l) | | | | | | | | | | 800 | | | | | | | | | |
| Mn (mg/l) | | 600 | | | | | | | | | | | | 600 | | | | | |
| Film appearance | | | | | Uniform and high density | | | | | | | | | #1 | #2 | Moire pattern | Uniform and high density | | |
| Scab resistance (mm) | 3.6 | 3.4 | 3.0 | 2.8 | 4.2 | 3.2 | 3.5 | 3.4 | 3.1 | 3.2 | 7.3 | 7.7 | 8.0 | 8.5 | 7.2 | 9.5 | 7.0 | 7.5 | 10.0 |

*Metaphosphate is a standard one [$(NaPO_3)_n$: n > 3] according to JIS-K-8892.
#1 Ununiform and high density.
#2 Uniform and high density.

The addition of metaphosphate ion in Examples 1 to 5 significantly enhances scab resistance in comparison with Comparative Example 1, and in Comparative Example 7 adding in a large amount does not show an improvement in proportion to the amount. It is believed that the surface treated film in Comparative Example 7 is too thin to enhance adhesive properties. Tetrametaphosphate (n=4) and hexametaphosphate (n=6) in Examples 6 to 10 show good technical effects equal to metaphosphate (n>3) in Examples 1 to 5, but trimetaphosphate (n=3) in Comparative Examples 2 to 4 does not show good scab resistance. Also, a linear polyphosphate (i.e. tripolyphosphate) in Comparative Examples 5 and 6 does not show good scab resistance.

It is therefore apparent that the enhancement of scab resistance is attained by the cyclic metaphosphate [$(MPO_3)$; $n>3$].

What is claimed is:

1. A surface treating agent for forming a zinc phosphate film on a metal surface, which is an acidic aqueous solution comprising zinc ions, nickel ions, phosphate ions, and 20 to 600 mg/l of a cyclic metaphosphate in the form of $(MPO_3)_n$ wherein M represents a metal atom and n is an integer of at least 4.

2. The surface treating agent according to claim 1 wherein the cyclic metaphosphate is tetrametaphosphate or hexametaphosphate.

3. A surface treating agent for forming a zinc phosphate film on a metal surface, which comprises zinc ions in a concentration of 600 to 2,000 mg/l, nickel ions in a concentration of at least 50 mg/l, phosphate ions in a concentration of 800 to 30,000 mg/l, and a cyclic metaphosphate represented by $(MPO_3)_n$ wherein M represents a metal atom and n is an integer of at least 4 in a concentration of 20 to 600 mg/l.

4. The surface treating agent according to claim 3, further comprising nitrate ions, nitrite ions, chlorate ions, fluorine ions or manganese ions.

5. A method for surface treating a metal surface before coating the metal surface, comprising contacting the metal surface with the surface treating agent according to any one of claims 1 to 4, and coating the treated surface with a paint.

* * * * *